United States Patent [19]

Stromquist

[11] Patent Number: 4,696,078

[45] Date of Patent: Sep. 29, 1987

[54] COMBINED ADJUSTABLE DOOR HINGE PIN SOCKET AND ADJUSTABLE TORQUE ROD ANCHOR DEVICE

[75] Inventor: Michael E. Stromquist, Encino, Calif.

[73] Assignee: Anthony's Manufacturing Company, Inc., San Fernando, Calif.

[21] Appl. No.: 375,754

[22] Filed: May 6, 1982

[51] Int. Cl.[4] ..... E05F 1/08

[52] U.S. Cl. ..... 16/301; 16/308

[58] Field of Search ..... 16/239, 245, 246, 250, 16/308, 298, 309, 299, 300, 301; 74/425, 89.14

[56] References Cited

U.S. PATENT DOCUMENTS

| | | | |
|---|---|---|---|
| 72,449 | 12/1867 | Burnham . | |
| 199,383 | 1/1978 | Steinhoff . | |
| 962,426 | 6/1910 | Hansen | 16/308 |
| 1,567,932 | 12/1925 | Eschenbacher . | |
| 1,731,028 | 10/1929 | Soss . | |
| 1,963,475 | 6/1935 | Schonitzer . | |
| 2,024,885 | 12/1935 | Schonitzer | 296/44 |
| 2,538,470 | 1/1951 | Peeples | 39/22 X |
| 2,878,531 | 3/1959 | Benham | 16/75 |
| 2,934,784 | 2/1957 | Price et al. | 16/308 |
| 3,331,159 | 7/1967 | Cooke et al. | 49/371 X |
| 3,507,074 | 4/1970 | Gallegos | 49/386 X |
| 3,584,332 | 6/1971 | Taylor | 16/245 |
| 4,142,272 | 3/1979 | Oogami et al. | 16/245 |
| 4,158,271 | 6/1979 | Barry | 49/386 X |
| 4,223,482 | 9/1980 | Barroero et al. | 16/75 X |
| 4,308,759 | 1/1982 | Sobotta | 74/89.14 X |

FOREIGN PATENT DOCUMENTS

| | | |
|---|---|---|
| 463555 | 3/1937 | United Kingdom . |
| 1044317 | 9/1966 | United Kingdom . |
| 1064878 | 4/1967 | United Kingdom . |
| 1145095 | 3/1969 | United Kingdom . |
| 1336046 | 11/1971 | United Kingdom . |

*Primary Examiner*—Howard N. Goldberg

*Attorney, Agent, or Firm*—Poms, Smith, Lande & Rose

[57] ABSTRACT

A self-closing door is disclosed being hinged at the top and at the bottom to swing between open and closed positions. A torque rod is aligned in the pivot axis of the door and is anchored at the bottom to a device secured to the cabinet frame. This device receives the end of the torque rod and serves as both the bottom hinge socket for the door's hinge pin associated with the torque rod assembly and as the bottom anchor for the torque rod. This device is provided with a worm wheel adjustable by a worm to provide the desired torque to the torque rod. The device is also provided with an apparatus to laterally adjust the bottom hinge socket so as to adjust the vertical alignment of the door's pivot axis to compensate for sag in the door and to insure that the horizontal frame members of the door are aligned with the cabinet.

4 Claims, 7 Drawing Figures

COMBINED ADJUSTABLE DOOR HINGE PIN SOCKET AND ADJUSTABLE TORQUE ROD ANCHOR DEVICE

BACKGROUND OF THE INVENTION

1. Field of the Invention

The present invention relates to doors, particularly to doors having their axis at one side and provided with a torque rod for self-closing, and more particularly to hinge pin sockets and torque rod anchors for commercial refrigerator doors.

2. Description of the Prior Art

Presently, many commercial refrigerator doors which are designed to swing open and closed about a side pivot axis, are hinged at their top by means such as a hinge pin which protrudes from the top edge of the door into a hinge socket provided in the upper cabinet frame. Further, many such commercial refrigerator doors are provided with a torque rod aligned along the pivot axis having its top end fixedly secured at a point near the top of the door and having its bottom end seated in an anchor integral with the bottom cabinet frame. The mating of the bottom end of the torque rod and the anchor also serves as the bottom hinge for the door.

FIG. 2 of the drawings illustrates an example of a conventional anchor socket combined with the bottom end of a conventional torque rod. In this conventional anchor socket, the torque rod is anchored against rotational movement by the provision of circumferentially spaced holes into which a pin is inserted to prevent rotation after the proper torque has been obtained by rotating the end with a convenient tool. These conventional torque rod adjustment devices are well-known to those skilled in the art.

However, this conventional means of providing the desired torque to the torque rod has many inherent disadvantages. One, the use of the pin mechanism is difficult and cumbersome to use and to re-adjust at a later time. Secondly, the pin torque rod adjuster, because of its incremental adjustment positions, is incapable of being adjusted to the exact desired torque.

An additional drawback in the use of a conventional anchor socket is that its location on the cabinet is fixed. Quite frequently, and particularly with older doors, the doors begin to sag under the weight of the door. This sagging results in the structural members of the door no longer being in a parallel relationship with the cabinet. This, besides being unsightly, can result in a poor seal between the door and its cabinet thereby causing loss of cooling in a refrigerator environment.

It is therefore an object of this invention to provide a new torque rod adjustment device for use in doors.

A further object of this invention is to provide a new door hinge mechanism.

Another object of this invention is to provide a combined adjustable door hinge pin socket and adjustable torque rod adjustment device.

A still further object of this invention is to provide a torque rod adjustment device which allows continuous and convenient adjustment of the torque, wherein the torque rod assembly serves as one of the vertical hinges.

Another object of this invention is to provide a door hinge pin socket which is laterally adjustable to allow changing the door's pivot axis and thereby eliminate any sag in the door.

The foregoing objects and others will become apparent to those skilled in the art and will be described in the following description of the invention.

SUMMARY OF THE INVENTION

According to this invention, a door assembly, such as a commercial refrigerator door assembly, is provided for selectively closing a rectangular opening through a cabinet or wall bounded by substantially horizontally upper and lower structural members, and substantially vertical side members.

Top and bottom vertically-aligned hinges connect the door to the top and bottom cabinet frame members so that the door is adapted to swing on a vertical pivot axis. To bias the door to a closed position so that it will be self-closing when released in the open position, a torque rod is positioned between and in alignment with the hinges, in fact one end of the torque rod serves as one of the hinge pins, preferably as the bottom hinge pin.

The upper end of the torque rod is secured to a member integral with the door, such as by means of a key connection, so that the upper end of the torque rod rotates with and only with the rotation of the door. The bottom of the torque rod assembly extends through the bottom of the door, serves as the bottom hinge pin, and mates with an anchor socket member attached to the bottom cabinet frame.

This anchor socket member serves to anchor the bottom end of the torque rod and to prevent its rotation relative to the cabinet, thereby causing the torque rod to be twisted when the door is opened which provides the energy to bias the door to return to the closed position.

This anchor socket member also serves as a socket for the hinge pin disposed at the end of the torque rod thereby establishing the bottom hinge for the door.

According to this invention, this new anchor socket comprises a base member and a cover. The base member is securely affixed to the bottom horizontal member of the cabinet and the cover is positioned on top of the base member and is secured thereto by a means that allows adjustment of the lateral position of the cover relative to the base member.

The cover is provided with a hinge pin socket which receives the door-supporting hinge pin associated with the end of the torque rod assembly, and it is in this socket that the door pivots in. The hinge pin socket has in its center an orifice which axially receives the terminal end of the torque rod. Axially disposed and aligned in this orifice is a worm wheel which has a non-circular orifice in its center which lockingly receives the terminal end of the torque rod which has a shape which prevents the end of the torque rod and worm wheel from experiencing relative rotation. Preferrably the orifice in the worm wheel and the terminal end of the torque rod have a mating shape (e.g. hexagon).

The cover is also provided with a worm which engages the worm wheel, so that by turning the worm the worm wheel can be turned, and thereby vary the torque of the torque rod to the desired strength.

According to this invention, the device also possesses a means for adjusting the lateral position of the hinge pin socket to thereby adjust the vertical orientation of the door's pivot axis to correct for sag or misalignment of the door with respect to the cabinet frame. This adjustment means comprises an adjustment member integral with the base member and being provided with a threaded hole parallel with the line of lateral adjustment, at least one non-threaded guide hole in the cover aligned with the threaded hole in the adjustment member, and a screw positioned in the guide hole and threaded into the threaded hole of the adjustment member, the screw having a means for maintaining its lateral relationship with the cover, so that when the screw is turned, the cover's lateral relationship with the base member is changed (see FIG. 4) and thereby changing the lateral position of the bottom hinge pin socket and the vertical orientation of the door's pivot axis.

DETAILED DESCRIPTION OF THE INVENTION

Figure 1:
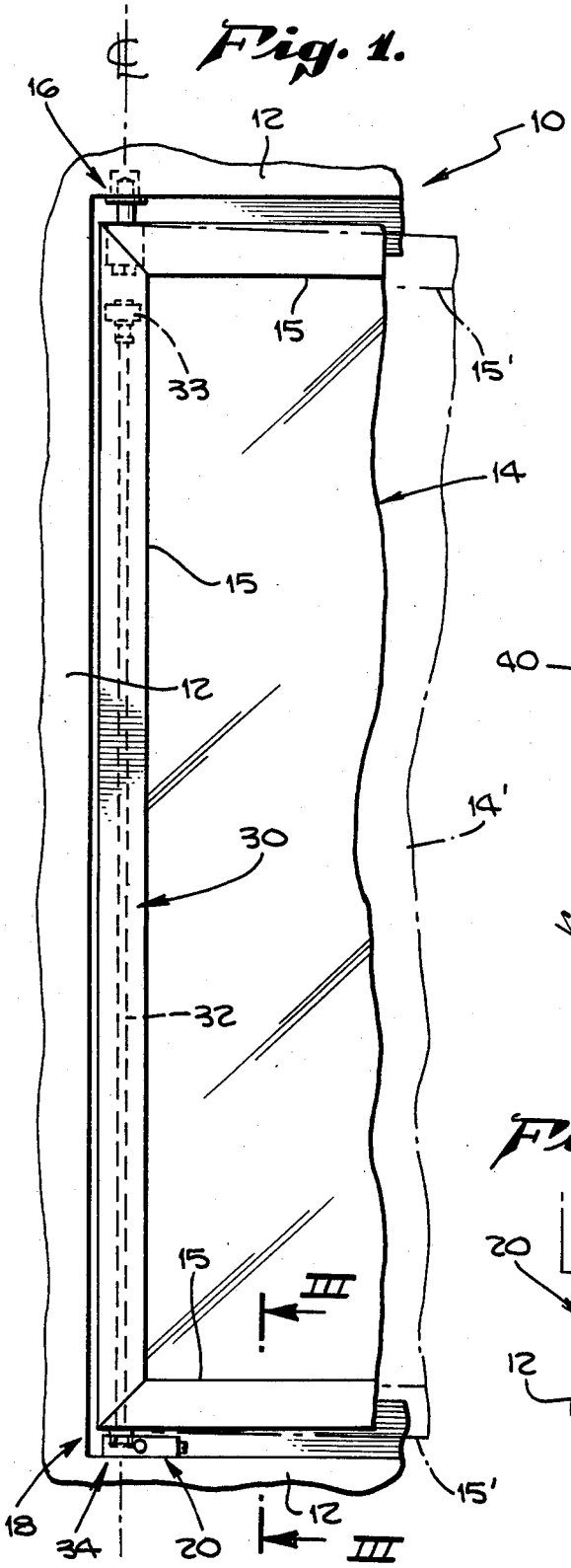
FIG. 1 is a partial elevation view of a refrigerator door showing the device of this invention installed and showing, in phantom, the sag and misalignment of the door.

Referring to FIG. 1, there is shown a conventional commercial refrigerator door assembly 10 with the torque rod adjustment and hinge pin socket device 20 of this invention installed. The door assembly 10 comprises a cabinet 12 having a top horizontal frame member, a bottom horizontal frame member, and two side frame members, only the left cabinet frame member appearing complete in the fragmentary view of FIG. 1. The door assembly 10 also comprises the door 14 with its peripheral frame 15.

Shown at the top of FIG. 1 is a conventional door hinge assembly 16, wherein a hinge pin is fixedly secured to the door 14 and protrudes upwardly, and is received by a hinge pin socket disposed in the top horizontal frame member of the cabinet 12. Shown at the bottom of FIG. 1 is the lower door hinge assembly 18, whose differences from the conventional door hinge will be described hereinafter. The upper door hinge assembly 16 and the lower door hinge assembly 18 together define the door's pivot axis about which the door swings. The pivot axis of the door is identified above hinge assembly 16, and at the lower hinge assembly 18 below the hinge assembly. FIG. 1 shows the door 14' and door frame 15' in phantom to represent the misalignment of the door relative to the cabinet 12 when the door 14 is in a sag condition.

Also present in the door assembly 10 of FIG. 1 is a torque rod assembly 30 which is conventional in all respects except for the features to be described hereinafter. The torque rod assembly 30 serves to provide a biasing force which is used to close the door 14 when it is released in the open position. The torque rod assembly 30 (also see FIG. 7) comprises the torque rod 32, a torque rod anchor member 33 integral with the door 14 and housed within the side door frame 15, and a torque rod anchor 34 secured to the lower horizontal structural member of the cabinet 12.

The upper end of the torque rod 32 has a non-circular shape (e.g. key shape) which is matingly received and secured in a mating aperture (e.g. key hole) in the upper torque rod anchor 33. This secure attachment prevents relative rotation between the upper end of the torque rod 32 and the door 14.

Figure 2:
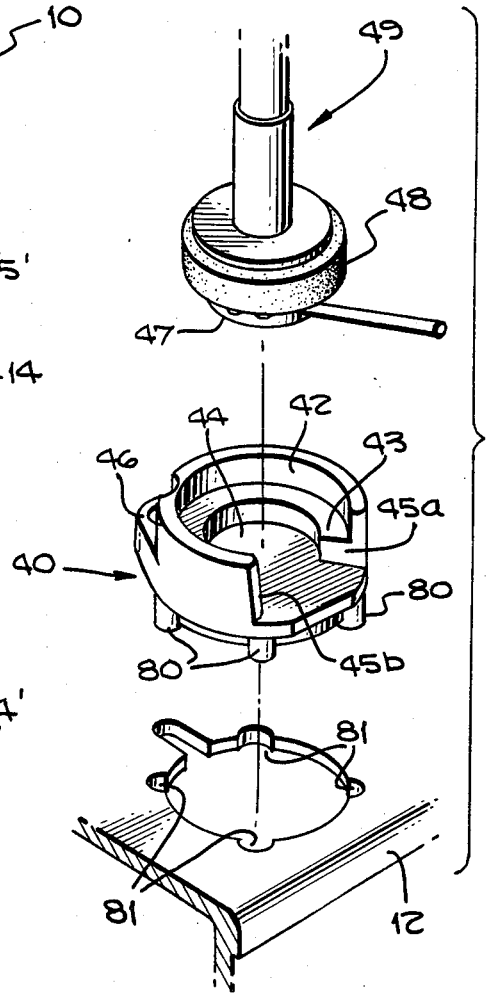
Fig. 2. PRIOR ART
FIG. 2 is an exploded view of the prior art anchor socket and the terminal end of a conventional torque rod assembly.
Figure 3:
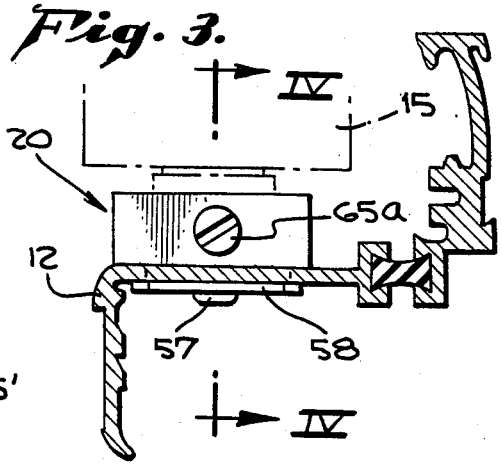
FIG. 3 is a sectional view of the installed device along the line III—III of FIG. 1.

Referring now to FIG. 2, a conventional torque rod anchor and hinge pin socket assembly is shown. The conventional anchor-socket 40 has an annular socket 42 with an annular seating surface 43 adapted to receive and support the hinge pin 48 of the torque rod 49, similar to the element 46 shown in FIG. 7. The hinge pin 48 is the element which carries the full weight of the door, and as the door is opened and closed, the hinge pin 48 rotates relative to the annular socket 42. It is also optional, but conventional, to prevent the direct contact between the hinge pin 48 and the annular socket by a friction-reducing cup loosely attached to the torque rod.

The conventional anchor-socket is also provided with a central circular aperture 44 which is adapted to receive the circular enlarged end 47 of a conventional torque rod. The conventional anchor-socket also has a lateral opening 45 defined by vertical walls **45*a* and 45*b*. This lateral opening serves two functions, one is to allow ease of access of the torque rod end 47 in the annular socket 42, and the other is to allow the adjustment of the torque rod adjustment mechanism. The conventional adjustment provides circumferentially-spaced radial apertures in the circular enlarged end 47 of the torque rod. The torque of the torque rod is then adjusted by inserting a tool into one of the apertures and twisting the torque rod until the desired bias is obtained and then inserting a small peg into one of the radial apertures which then abuts one of the side walls 45*a* or 45*b* of the lateral opening 45** to thereby lock-in the desired torque.

The conventional anchor-socket 40 and the lower horizontal structural member of the cabinet are provided with mating protrusions 80 and recesses 81 so that the anchor-socket 40 can be rotatively secured (i.e., secured against rotation) to the cabinet 12. The anchor-socket 40 is also preferably provided with a screw hole 46 which allows the anchor-socket 40 to be securely attached to the cabinet 12.

The conventional torque adjustment mechanism described above is difficult to use for many reasons, among which is the fact that it requires two hands to rotate the rod through one arc from one wall of the lateral opening 45 to the other wall and inserting and pulling the tool and pegs alternately from consecutive apertures until the desired torque is achieved. Further, this adjustment mechanism only allows incremental adjustment and can not allow continuous or fine adjustment, thereby creating a situation where one setting may provide too much bias and the next lower setting may provide too little bias.

Another problem inherent in the conventional anchor-socket described above is the fact that because all of the weight of the door rests on the bottom anchor-socket which is positioned at the edge of the door, the door has a tendency to want to rotate about the bottom hinge and rotate the door's pivot axis out of its intended vertically-aligned position, thereby causing the door to sag and vary from its intended parallel alignment with the cabinet.

Because the conventional anchor-socket can not be moved or adjusted, there is no way for it to compensate or correct the angle of the door's pivot axis.

Therefore, as described above, and in view of the inherent failings of the conventional anchor socket, the device of the present invention is intended to overcome these deficiencies by providing a convenient means to adjust the torque of a torque rod and to adjust the lateral position of the hinge pin socket to correct any sag or misalignment in the door.

Figure 7:
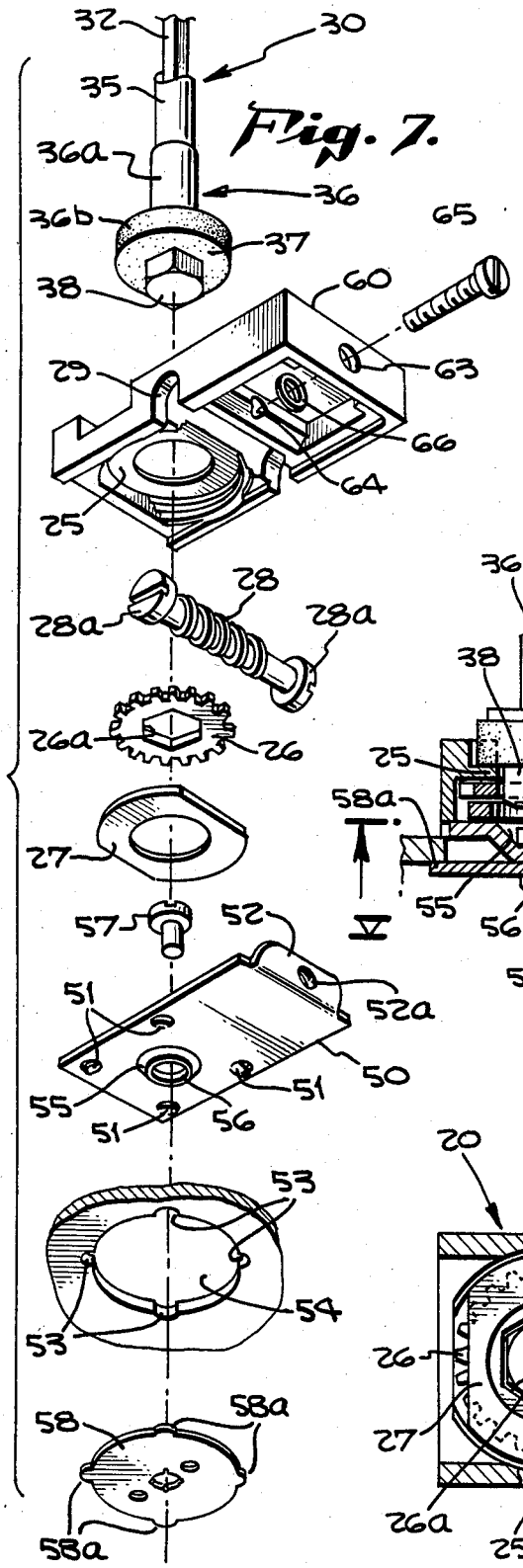
FIG. 7 is an exploded view of the installed device in association with the end of a torque rod assembly.
Figure 6:
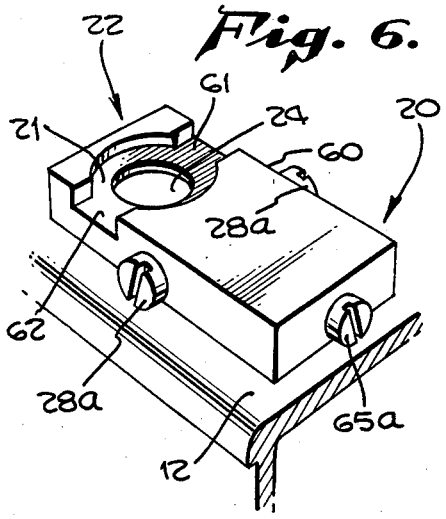
FIG. 6 is a perspective view of the device of this invention installed.

Turning now to FIGS. 3–7, and in particular to FIG. 7, there is shown the preferred embodiment of the present invention. The preferred embodiment is intended for use as the bottom pivot point of the door, although it will be appreciated by those skilled in the art that it could be used as well as the top pivot point of the door.

FIG. 7 is an exploded view of the preferred embodiment of this invention. The torque rod assembly 30 as shown in the preferred embodiment comprises a torque rod 32. The torque rod 32 may be, for example, of selected spring steel of high fatigue resistance and which retains its torsional resiliency during many years of use when forcibly twisted through an arc of 90° or more. A sleeve 35, preferrably plastic, loosely surrounds the rod 32 for essentially the entire length of the rod 32. This sleeve protects the rod from contacting other components in the door and facilitates its operation. Disposed near the end of the torque rod 32 is a hinge pin 36 which comprises a cylindrical sleeve portion **36*a* and an integral enlarged shoulder portion 36*b*. A circular orifice runs through the middle of the hinge pin 36 through which the torque rod 32 freely passes. The hinge pin 36 functions as follows, the sleeve portion 36*a* is disposed in and is free to rotate within an aperture in the bottom side of the door frame 15, and the enlarged shoulder 36*b* is received in the hinge pin socket 22 of the device 20. It is also preferable to position a friction-reducing cup 37 around the bottom of the hinge pin 36 which can rotate relative to the enlarged shoulder portion 36*b*. Because the entire weight of the door 14 is transmitted to the bottom surface of shoulder 36*b*, and this weight is then borne by the annular hinge pin socket seating surface 21, the friction-reducing cup 37 provides a desirable reduction in friction between the relative rotating surfaces. At the very end of the torque rod 32 and integral therewith is a hexagonal head 38 which mates with the device 20** in such a way that the torsion of the torque rod can be adjusted. Although a hexagonal shape is disclosed as the preferred embodiment, any shape or means that can lockingly mate with the worm wheel to be hereinafter described can be employed (e.g. any non-circular shape).

The devide 20 of this invention basically comprises the base member 50, a cover 60, a torque adjustment mechanism for adjusting the torque of the torque rod, and a lateral adjustment mechanism for adjusting the lateral position of the hinge pin socket.

Figure 4:
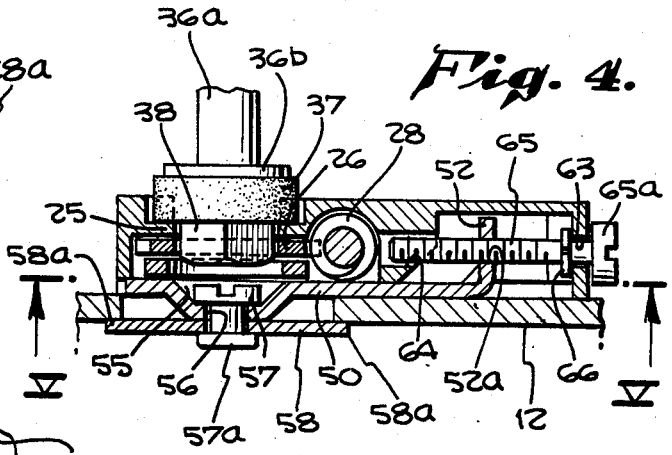
FIG. 4 is a sectional view of the device of this invention taken along the line IV—IV of FIG. 3.

The base member 50, best seen in FIG. 7, is intended to fixedly attach the device 20 to the cabinet 12. In order to utilize the orifices presently found in some cabinets which use the conventional anchor socket illustrated in FIG. 2, the base member 50 is provided with four protrusions 51 which seat in the four mating recesses 53 circumferentially spaced about the edge of aperture 54. Once the base member 50 is positioned over the aperture 54 it can not move laterally relative to the cabinet 12, nor rotate in the aperture 54. In order to prevent the base member 50 from lifting out of the aperture 54, the following method of assembly is used. The base member 50 is provided with a centrally located and downwardly-protruding nipple 55 having a rivet receiving orifice 56 therein and a screw head rivet 57 is inserted through the rivet-receiving orifice 56 from above and is further inserted into the receiving orifice of a locking element 58. This locking element 58 is flat and has four circumferentially spaced protrusions and is shaped so that it can mate with but pass through the aperture 54. As seen in FIG. 4, the base member 50, the rivet 57, and the locking element 58 are attached to each other. FIG. 4 shows rivet 57 with its end **57*a* flattened so as to retain the locking element 58. The rivet 57 is sized so that it is tightly received by the orifice in the locking element 58 so that the locking element 58 can be rotated by turning the rivet 57. When installing the base member 50, the locking element 58 is rotated so that its protrusions 58*a* rest on the protrusions 51 integral with the base member 50. This positioning allows the locking element 58 to pass through the aperture 54 when the base member 50 is lowering onto the cabinet 12, then by turning the rivet 57, the locking element 58 is rotated and the protrusions 58*a* now are locked behind the underside of the cabinet 12, thereby preventing withdrawal of the base plate 50 from the cabinet 12**.

The cover 60 is attached to the base member 50 and serves two functions: (1) it provides a socket for the bottom hinge pin 36; and (2) it provides an anchor for the bottom end 38 of the torque rod 32. The cover 60 is provided with a recessed annular seating surface 21 which is circular and sized to mate with the hinge pin 36 and to allow it to rotate within the socket. The cover 60 is also provided with two side openings 61 and 62 to provide ease of installation of the door 14 and torque rod assembly 30 in the cabinet 12. Although only one side opening is needed, providing two side openings allows the device 20 to be used for both left and right-handed doors. A torque rod orifice 24 is provided in the center of the hinge pin socket 22 sized to receive the hexagonal head 38 at the end of the torque rod 32.

A worm gear mechanism is housed in the cover 60, and comprises a worm wheel 26, a worm wheel cover 27, and a worm 28. The worm wheel 26 is disposed adjacent to the surface 25 which is the underside of the hinge pin socket seating surface 21. The center of the worm wheel 26 has an aperture **26*a* which is shaped to matingly receive the hexagonal head 38 of the torque rod 32, such that the worm wheel 26 and the bottom end of the torque rod are rotatively engaged. Worm wheel cover 27 is positioned axially adjacent to and under the worm wheel 26. This cover 27 is adapted to shield the rotating worm wheel 26 from extraneous parts and to hold it in position. A worm 28 is housed in a cylindrical channel 29 in cover 60. The worm 28 is disposed perpendicularly to the lateral extension of the cabinet 12 so that the screw heads 28*a* on the ends of the worm 28 are accessible to a screwdriver or other implement for turning. It can therefore be seen that by turning the worm 28 the worm wheel 26 is rotated which rotates the hexagonal head 38** of the torque rod, and thereby allows fine and continuous adjustment of the torque rod.

Turning our attention now to the hinge pin socket lateral adjustment mechanism, it is frequently desirable to adjust the lateral position of the hinge pin socket 22, either to the left or to the right to vary the angle of the door's pivot axis in order to compensate for any sag or misalignment in the door.

Figure 5:
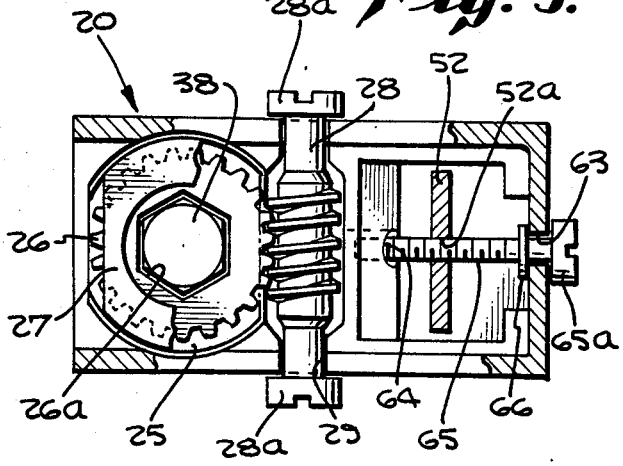
FIG. 5 is a sectional view of the device taken along the line V—V of FIG. 4.

The hinge pin socket lateral adjustment mechanism of this invention is provided for in the preferred embodiment in a manner to be now described. The base member 50 is provided with an extension 52 perpendicular to the base member 50, which is provided with a centrally disposed threaded aperture 52*a* parallel to the lateral extension of the bottom of the cabinet 12. The cover 60 is provided with two screw guide holes, 63 and 64. These guide holes are aligned with the threaded aperture 52*a*, but are not threaded and are sized so that they guide and retain the adjustment screw 65 in its intended position in the cover 60. The adjustment screw 65 is provided with a head 65*a* which allows turning of the screw 65, and the screw 65 is also provided with a lock nut 66 which is disposed around the screw 65 on the inside surface of the cover 60. This lock nut is positioned as shown in FIGS. 4 and 5 and serves to prevent the screw 65 from moving laterally relative to the cover 60. The arrangement described thus provides that when the lateral adjustment screw 65 is rotated by turning the screw head 65*a*, the threaded engagement of the screw 65 with the threaded hole 52*a* produces lateral movement of the cover 60, thereby changing the lateral position of the hinge pin socket 22.

The foregoing detailed description of the preferred embodiment of the invention is exemplary only, and it should be understood that other modifications obvious to those skilled in the art may be made, and are intended to be within the scope of this invention, which is defined and limited only by the following claims.

The invention now having been described, I claim:

1. A torque rod adjustment device for use in a torsionally operated door assembly having a door that swings on hinges about a vertical pivot axis on one side of the door, and a surrounding cabinet wherein a torque rod is positioned along the pivot axis of the door and has one of its ends secured to the door to prevent rotation of said end relative to the door and has its other end secured to the cabinet to prevent rotation of this end relative to the cabinet, said torque rod adjustment device comprising:

a base member adapted to be fixedly secured to the cabinet;

a cover connected to the base member and having an anchor therein to receive the end of the torque rod to be secured to the cabinet;

a worm wheel rotatively housed in the cover and having a central aperture adapted to matingly receive the end of the torque rod in a non-rotative relationship; and a worm housed by the cover in engaging relationship with the worm wheel and adapted to be selectively turned so as to adjust the torque of the torque rod.

2. A device for adjusting the torque rod in a torsionally-operated door assembly and for adjusting the pivot axis for the door wherein the door assembly has a door that swings on hinges disposed at the top and at the bottom, and a surrounding cabinet providing two vertical structural members at the sides of the door and two horizontal structural members, one at the top and one at the bottom of the door, wherein the hinges comprise vertical hinge pins protruding from the top edge and bottom edge of the door and defining the pivot axis of the door, said vertical hinge pins engaging and mating with axial sockets secured to the top and bottom horizontal structural members of the cabinet, said door assembly further comprising a torque rod positioned along the pivot axis of the door having one of its ends secured to the door to prevent rotation of said end, when opening the door, relative to the door, and has its other end secured to the cabinet to prevent rotation of this end, during opening of the door, relative to the cabinet, wherein the end of the torque rod that is secured to the door also provides one of the vertical hinge pins;

said device comprising:

a base member adapted to be fixedly secured to the cabinet;

a cover disposed over the base member and having a socket adapted to matingly receive the end of the torque rod thereby combining to serve as a hinge for the door;

means for adjusting the lateral relationship of the cover with the base member so as to adjust the lateral position of the hinge pin socket;

a worm wheel rotatively housed in the cover and having a central aperture adapted to matingly receive the end of the torque rod in a non-rotative relationship; and a worm housed by the cover in engaging relationship with the worm wheel and adapted to be selectively turned so as to adjust the torque of the torque rod.

3. The device claimed in claim 2, wherein the lateral adjusting means comprises:

an adjustment member integral with the base member and provided with a threaded hole parallel with the line of lateral adjustment;

said cover being provided with at least one non-threaded guide hole aligned with the threaded hole; and a screw positioned through the guide holes and threaded into the threaded hole of the adjustment member, said screw having a means for maintaining its lateral relationship with the cover;

so that when the screw is turned, the lateral relationship of the cover and the base member is changed thus altering the lateral position of the hinge pin socket.

4. A device for use in a side-swinging door assembly having a door that swings on hinges disposed at the top and at the bottom of the door, and a surrounding cabinet, wherein the hinges comprise vertical hinge pins protruding from the edge of the door and defining the pivot axis of the door, said vertical hinge pins engaging and mating with axial sockets disposed in the cabinet, said device also for providing the axial socket to receive one of said vertical hinge pins, said device comprising:

a base member adapted to be fixedly secured to the cabinet;

a cover disposed over the base member and having a socket adapted to matingly receive one vertical hinge pin; and means for adjusting the lateral relationship of the cover with the base member comprising an adjustment member integral with the base member and provided with a threaded hole parallel with the line of lateral adjustment;

said cover being provided with at least one non-threaded guide hole aligned with the threaded hole; and a screw positioned through the guide holes and threaded into the threaded hole of the adjustment member, said screw having a means for maintaining its lateral relationship with the cover;

so that when the screw is turned, the lateral relationship of the cover and the base member is changed thus altering the lateral position of the hinge pin socket.

* * * * *